US006659837B1

(12) United States Patent
Lieberman

(10) Patent No.: US 6,659,837 B1
(45) Date of Patent: Dec. 9, 2003

(54) INFLATABLE RADIO CONTROL CAR

(75) Inventor: Marvin S. Lieberman, New York, NY (US)

(73) Assignee: Alvimar Manufacturing Co., Ltd., New York, NY (US)

( * ) Notice: Subject to any disclaimer, the term of this patent is extended or adjusted under 35 U.S.C. 154(b) by 0 days.

(21) Appl. No.: 10/286,612

(22) Filed: Oct. 31, 2002

(51) Int. Cl.[7] ..... A63H 3/06
(52) U.S. Cl. ..... 446/220; 446/454; 446/465
(58) Field of Search ..... 446/220, 221, 446/225, 226, 465, 454, 470, 456, 457, 431

(56) References Cited

U.S. PATENT DOCUMENTS 4,160,253 A * 7/1979 Mabuchi et al. ..... 343/225
4,161,077 A * 7/1979 Ciaccio et al. ..... 43/26.1
4,168,468 A * 9/1979 Mabuchi et al. ..... 325/37
4,334,221 A * 6/1982 Rosenhagen et al. ..... 340/825
4,406,085 A * 9/1983 Rhodes ..... 46/254
4,966,569 A * 10/1990 Asano ..... 446/440
5,050,505 A * 9/1991 Konno ..... 104/295
5,429,543 A * 7/1995 Tilbor et al. ..... 446/456
5,481,257 A * 1/1996 Brubaker et al. ..... 340/825.69
5,512,002 A * 4/1996 Lieberman ..... 446/221
5,709,583 A * 1/1998 Suto et al. ..... 446/440
5,762,533 A * 6/1998 Tilbor et al. ..... 446/466
5,816,352 A * 10/1998 Hacker ..... 180/167

* cited by examiner

*Primary Examiner*—Derris H. Banks
*Assistant Examiner*—Jamila Williams
(74) *Attorney, Agent, or Firm*—Amster, Rothstein & Ebenstein LLP

(57) ABSTRACT

A remote control car made of plastic sheet has an body with fixed wheels and a remotely controlled electromechanical drive unit with rotatable wheels in a cavity in the bottom of the inflatable body.

10 Claims, 5 Drawing Sheets

14
15
28
32
81
22
50A
50E
50B
50
50C
50D
50F
27
52A
52B
52C
52D
52E
21
80
32
57
58
53A
53B
53C
53D
29
23
35
71
72
73
60
61
68,69
62

INFLATABLE RADIO CONTROL CAR

FIELD OF THE INVENTION

This invention is in the field of inflatable articles made of plastic sheet used as promotional displays and toys. More particularly, this invention is an inflatable article having the form of an car whose shape and graphics thereon is used to promote a particular source, such as the famous NASCAR organization and to serve as a toy.

BACKGROUND OF THE INVENTION

The field of inflatable promotional displays has long included articles such as replicas of beer bottles, blimps, cameras, cartoon characters, famous buildings, footballs and other sports and commercial items, persons and animals.

Primarily, these articles are intended to stand alone or to be suspended; however, by their nature of being inflated low-density, balloon-like articles, they are generally not stable when pushed or tipped and not suitable to be mobile or motorized.

In the field of promotional display articles, the most popular articles are small, relatively heavy items like desk clocks, glass snow-globes, pen and pencil sets in marble stands, calculators and even radios. In summary, promotional displays are normally not toys that are mobile. This is logical, since their purpose is to be seen in a designated place and seen repeatedly by as many people as possible.

Examples of inflatable structures to replicate actual products include applicant's own U.S. Pat. No. 5,512,002 for an inflatable car, U.S. Pat. No. 6,161,902 for an inflatable chair and U.S. Pat. No. 6,322,107 for an inflatable polyhedron calendar. These patents particularly U.S. Pat. No. 5,662,509 disclose a conventional structure and method of manufacturing an inflatable car of the present invention our of PVC plastic sheet. These patents are incorporated by reference for their disclosures of these materials, structures and manufacturing techniques known in the prior art.

Long ago, it was realized that one of the easiest, quickest and least expensive ways to create a large display was to utilize inflatable replicas of the product being sold, such as beer bottles, hot dogs, cameras and even cars. Large inflatable balloon-like replicas might be filled with helium and tied to the ground or merely filled with air and situated on a support surface but they are too unstable to be motorized.

The background of this invention further includes remote and radio controlled toys which include cards, trucks, planes and boats. Exemplary U.S. patents that disclose such toys include U.S. Pat. Nos. 5,816,352, 5,762,533, 5,709,583, 5,481,257, 5,429,543, 5,050,505, 4,966,569, 4,406,085, 4,334,221, 4,168,468, 4,161,077 and 4,160,253 all of which are incorporated herein by reference for their disclosures of know radio control transmitters, receivers and motorized drive units for actuating said toys.

SUMMARY OF THE INVENTION

The present invention combines two old concepts into a novel and entertaining inflatable promotional display. More specifically, the new invention, in effect, marries (a) a balloon-like, inflatable racing car replica with (b) a motor drive normally associated with a rigid metal or plastic body, to result in an unexpectedly delightful radio-controlled inflatable car. Such a marriage would normally not even be contemplated because motorized vehicles, such as cars and trucks are invariably relatively small and relatively heavy and rigid metal or plastic frames which can readily be secured to the drive unit, and can be readily maneuvered.

To achieve such an inexpensive marriage of the diverse elements of a large balloon-like car with a small radio-controlled drive unit, applicant-designed a cavity or pocket in the lower surface of the car's plastic sheet body. Such inward cavity is unusual since most elements of an inflatable article project outward, such as arms, ears, or any parts driven outward by the air pressure within. The only inward-extending cavities in an outwardly inflatable article known to applicant are found in applicant's own inflatable chair and its own inflatable snack table. In the chair, the cavity is a pocket on a top surface of the armrest to receive a beer can. Clearly, this cavity has to be oversized so that the beer can will be easily inserted and removed. In the snack table, the cavity is also on a top surface to receive a food bowl. Both of these inflatable products merely receive an article in a top surface cavity, and neither allows the inflatable product to function in a different way because of the changed sructure and the new combination of elements.

In the new invention an inward extending cavity is provided in contrast to all other elements which extend outward when the car is inflated. This cavity has inward extending side walls which grasp the drive unit as the side walls tend to billow laterally toward each other, and against the outer walls of the drive unit. This, with optional additional securing means, retains the drive unit within the cavity and thus within the balloon-like auto replica. This structural arrangement adds to realism, as the drive unit, located under the center of the auto, is not readily visible. Also, this positioning at the center of the gravity of the inflated auto allows it to remain upright and stable while it travels on the motor-driven wheels.

Such an auto replica bearing promotional graphics, traveling about on a floor and turning and reversing under otherwise invisible radio control is an amusing sight largely because it is so unexpected to see what appears to be a very large toy maneuvering about without visible human direction. Prior to the present invention it was not practical to have a three-foot long radio-controlled toy car of metal or plastic body, because a large and powerful motor and drive unit would be required, and it would be heavy, expensive and a nuisance to store. The present invention provides numerous advantages, beginning with (a) the small size when uninflated, stored or shipped (b) its very low cost and (c) its relatively large size for a mobile replica car (which has the benefits of a toy for children and adults while primarily being a promotional display).

The present invention in its preferred embodiment is a remote controlled inflatable car as seen in the drawings appended hereto.

As seen herein, essentially all parts of this inflatable vehicle extend outward as is normal in an article of flexible plastic sheet material inflated with air. Thus, the body side walls, roof, hood, rear deck and bottom are all blown outward due to the internal air pressure, as is known in the prior art and as exemplified in applicant's U.S. Pat. Nos. D419,207 and 5,512,002 for inflatable cars.

The unique difference in the present invention is an inward-extending cavity in the bottom wall which receives and holds a radio receiver and power drive unit including steerable front wheels and rear drive wheels, where the vehicle is controllable to move forward or rearward optionally at varying speeds and to turn. This radio-controlled transmitter receiver and steerable drive unit is well-known in the prior art as commonly used in small rigid body metal or plastic vehicles which are often operated as midget race cars, fire engine, or the like. All these vehicles are designed to appear as replicas of real vehicles with the drive wheels being the actual front or rear wheels of the vehicle, and the steered wheels being the actual front wheels of the vehicle.

The new invention has front and rear wheels that are realistic in appearance, but do not rotate, and a second set of front and rear wheels extending from the drive unit situated under the bottom surface of the car near the midpoint thereof. This drive unit is an integrated assembly of a power supply established by common batteries, a radio receiver having multiple channels coupled to various drive elements for operating a steering mechanism associated with the front wheels, and for forward and rearward drive-mechanized speed control associated with the rear wheels.

A preferred embodiment of this invention will now be described with reference to the appended drawings.

DETAILED DESCRIPTION OF THE PREFERRED EMBODIMENT

Figure 1:
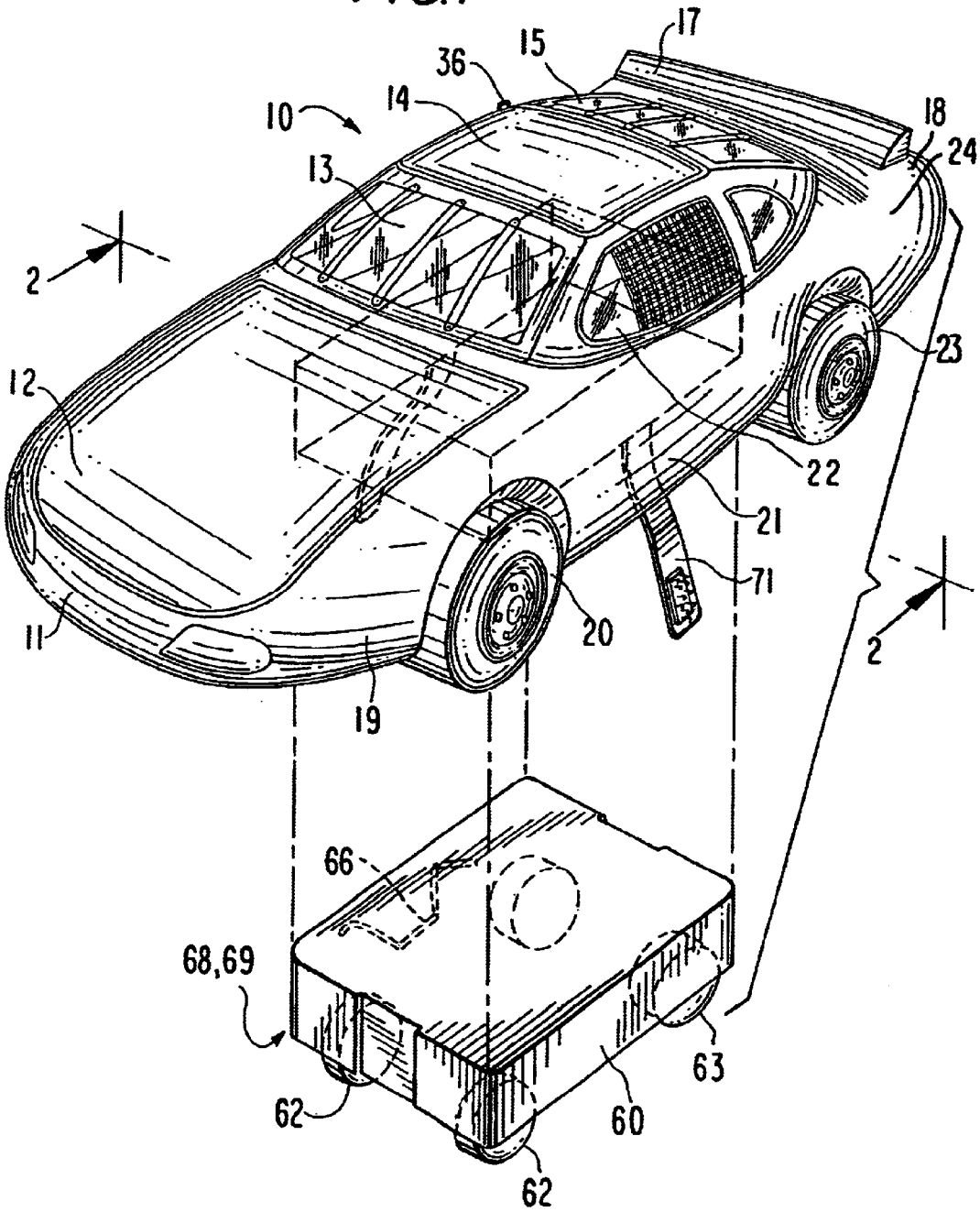
FIG. 1 is a top and front perspective exploded view of my new Inflatable Remote Control Car.

The new inflatable remote control car 10 as illustrated in the preferred embodiment shown in FIGS. 1–6 will be described first in terms of its outer components, then in terms of its inner chambers, and then in terms of the internal structure to define and maintain the shapes of the inner chambers and the outer components.

With respect to the outside parts, there is the front bumper 11, the 15 hood 12, the front windshield 13, the top 14, the rear window 15, the trunk lid 16, the spoiler 17 and the rear bumper 18. As seen in FIGS. 1–6. Also in these figures is left front fender 19, left front wheel 20, left side door 21, left side door window 22, left rear wheel 23 and left rear fender 24. The right side is essentially the mirror image of the left side, these parts being marked with reference numbers in FIG. 4 as right front fender 25, right front wheel 26, right side door 27, right side door window 28, right rear wheel 29 and right rear fender 30.

Figure 2:
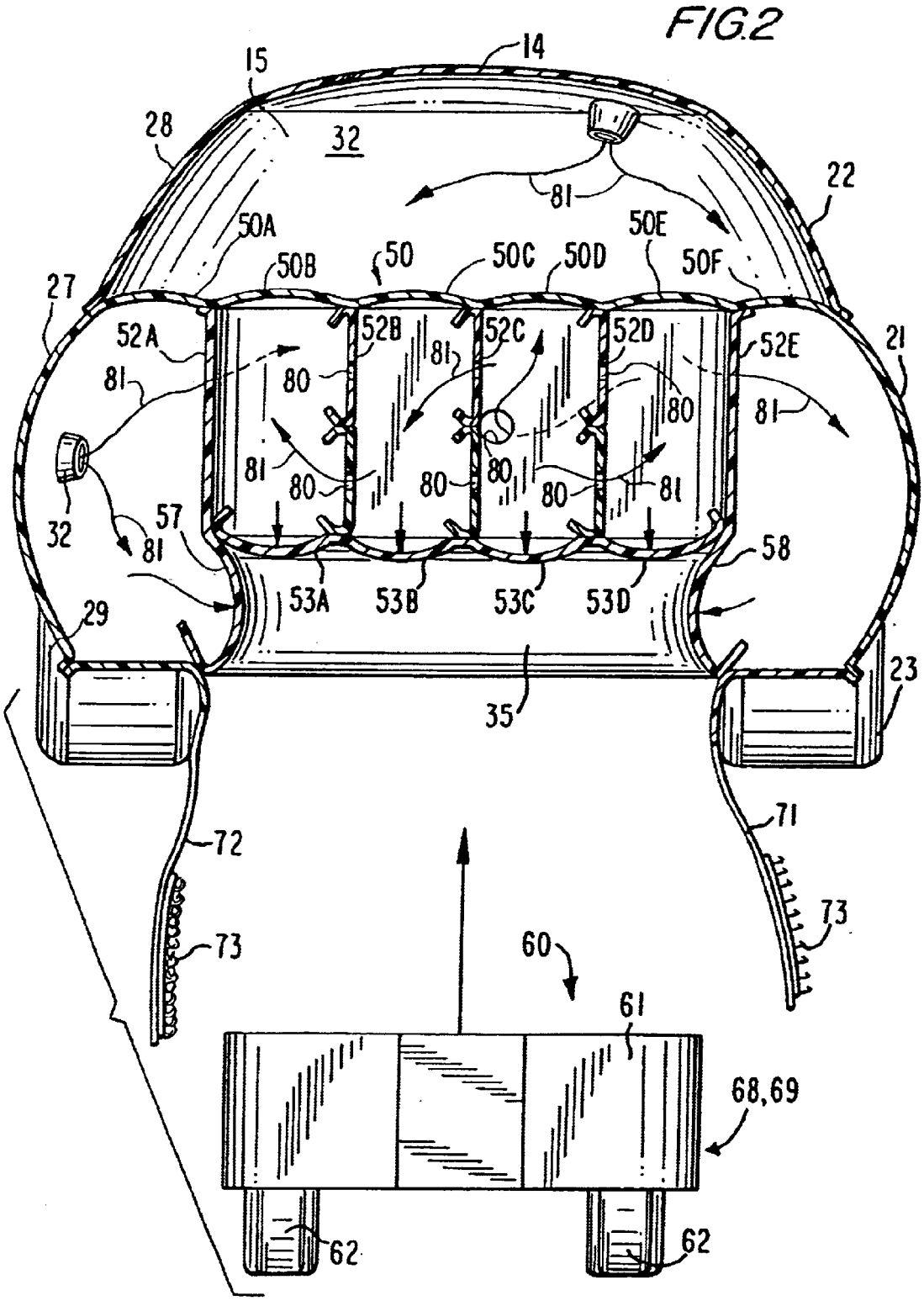
FIG. 2 is a sectional view taken along line 2—2 and looking rearward in FIG. 1, showing the empty cavity for receiving the radio control receiver unit.
Figure 5:
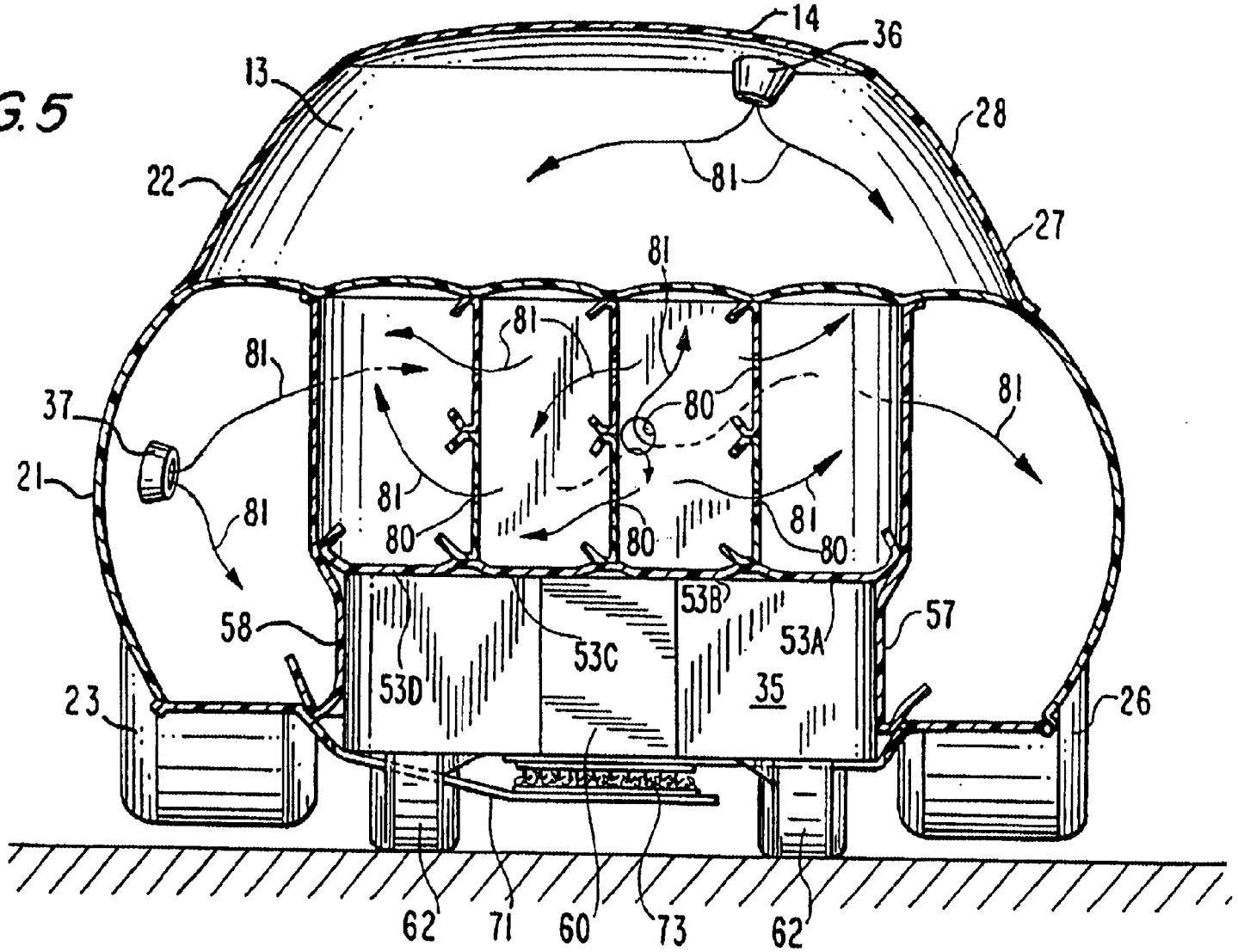
FIG. 5 is a sectional view taken along line 5—5 in FIG. 3, showing the cavity with the receiving unit installed therein.

These outer elements define the outer parts and shape of this car. As seen in FIGS. 2, 5 and/or 6 the internal chambers are the engine include compartment 31 beneath hood 12, the passenger compartment 32 beneath roof 14, the trunk compartment 33 beneath the trunk lid 16, the central area 34 beneath the passenger compartment and the recess or chamber 35 beneath the passenger compartment 32.

Figure 6:
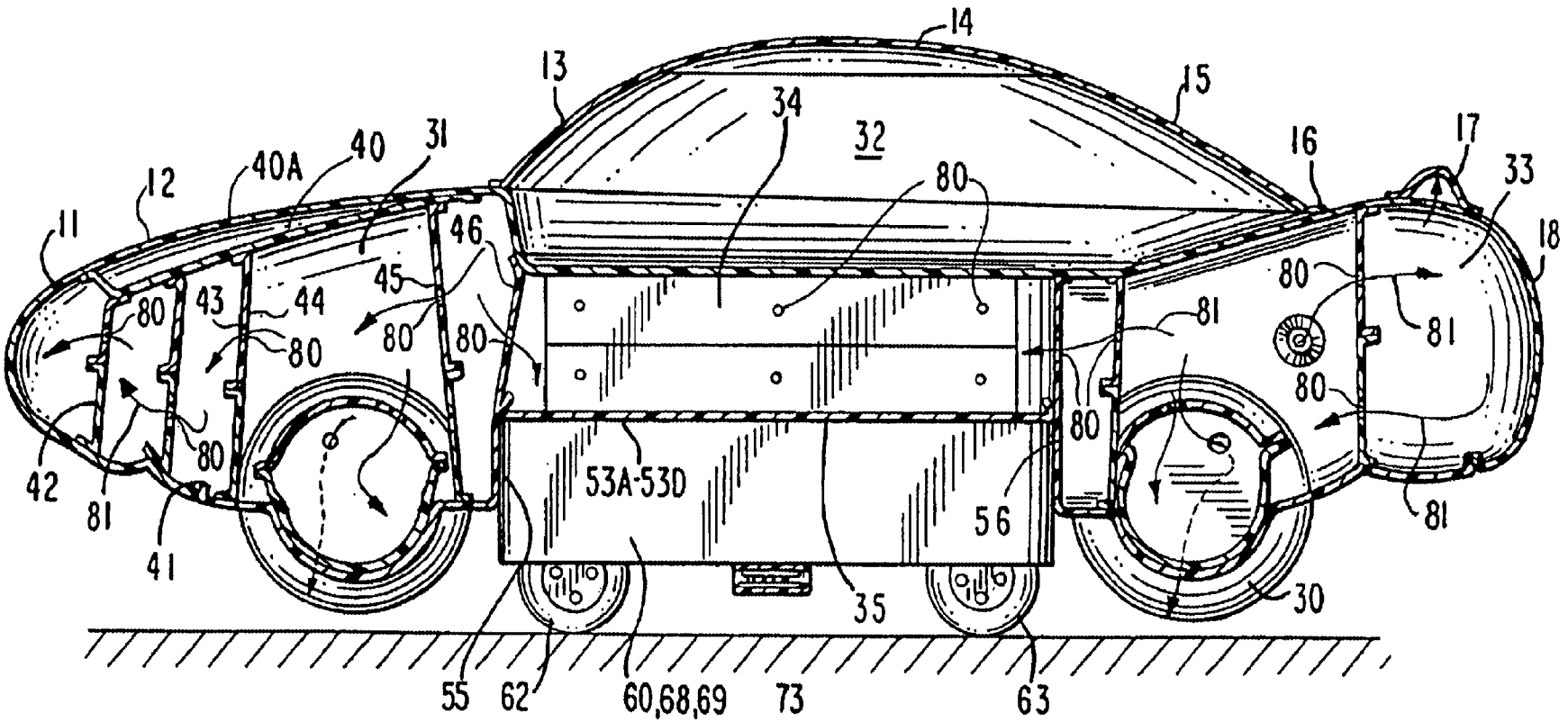
FIG. 6 is an elevational sectional view taken along line 6—6 in FIG. 4, with the receiver unit installed in the car's cavity.

In this particular embodiment the passenger compartment 32 is inflated via a valve 36 (See FIG. 2), and all of the remaining chambers namely the engine compartment 31 and the central area 34 and the trunk 33 and the wheels 20, 23, 26, and 30 are all in air flow communication with each other and are inflated via a valve 37 seen on the right side of the car as viewed in FIGS. 2, 5 and 6. In order for all of these chambers other than the passenger compartment to be inflated via a single valve, there has been provided in the internal structure a plurality of air-flow apertures between various structural elements as will be described below. It is possible of course to have designed numerous additional separate chambers with separate air valves for each, or to have made every single chamber in air flow communication with the other so that only a single valve is required.

As seen in the various figures, the shape of the car is achieved not only by the selected shape of the outer elements, but by the internal structures commonly called I-beams which engage outer surfaces and keep them from blowing or billowing outward into a generally round bulbous or balloon shape. Accordingly, in the engine compartment 31, as seen for example in FIG. 6, there is for hood 12 an upper sheet 40, and a lower sheet 41 made up of a number of elements and intermediate generally vertically oriented I-beams 42, 43, 44, 45, and 46 which establish the height between upper sheet 40 and lower sheet 41 and establish the generally horizontal orientation of these sheets. There is a secondary upper sheet 40A immediately above and slightly spaced from sheet 40 which is utilized to provide a smoother top surface of the hood 24, which thus more accurately replicates a real race car. These I-beams and all of the elements of the car are made of sheet plastic where their various intersecting joints are connected by well-known heat sealing methods.

Also in the vicinity of this engine compartment 31 at the lower part thereof are formed the front wheels as generally separate cylindrical air chambers but which communicate with the engine compartment space via apertures in the wall segments of sheet plastic which define these elements. Sometimes the wall segments are separate for each chamber and sometimes they constitute common walls between two chambers and serving as the wall for each of the adjacent chambers.

As seen in FIG. 2, the passenger compartment 32 has a roof or ceiling 14, an open upper part extending down to a mid-level plane, and a lower part 50 made up of a plurality of sheet segments 50A, 50B, 50C, 50D, 50E and 50F. These segments 50A through 50F define a generally horizontal bottom wall or floor of the passenger compartment which ripples slightly because of the air pressure; however, these segments do not billow up into one high arched curve because each is restrained by at least two vertical I-beams designated as 52A, 52B, 52C, 52D and 52E. Each of these vertical segments 52A through 52E is connected at its lower surface to a bottom element 53A, 53B, 53D, and 53C and 53D respectively. Thus, relatively horizontal elements 50A through 50F and relatively horizontal elements 53A through 53D and vertical elements 52A through 52E establish a plurality of generally parallel and adjacent rectangular box structures. The elements 53A–53D together establish a horizontal ceiling for the radio controlled drive unit chamber space 35.

As seen in FIG. 6 this chamber 35 has front wall 55 and rear wall 56, and as seen in FIG. 5 chamber 55 has right side wall 57 and a left side wall 58. In FIG. 5 it should be noted that right and left walls 57 and 58 each bow slightly inwardly since the air pressure in the adjacent fender chamber urges them in that direction. As seen in FIG. 6 front wall 55 and rear wall 56 also bow inwardly, the inward pressing of these walls helps to engage and hold the radio control drive unit 60 in the space 35 provided for it.

As is known and as is evident in these drawings, inflatable articles by their nature inflate from the inside outward, such as the roof pushing upward and the doors pushing outward, and the wheels also being inflated in an outward direction. However, in the new design there is achieved inwardly directed walls of chamber 35 established on the underside of the car which not only engages and holds the radio control drive unit, but essentially hides and camouflages the unit and the wheels thereof from being seen by viewers. Such viewers cannot easily see underneath the car where the drive unit's functioning wheels engage the ground, and in so doing elevate the car's inflatable non-functioning wheels slightly above the ground. Thus, the elevated inflated wheels do not drag and add friction when the car is moved, but appear to be the car's real wheels such that this unit is a reasonably accurate and realistic replica of a NASCAR race car.

The radio control drive unit 60 as seen in FIGS. 1 through 6 comprises a generally rectangular housing 61, a set of steerable front wheels 62 and a set of forward and reversing rear drive wheels 63. Within housing 61 is a standard radio control receiving unit, (68) but well known in the prior art of radio control sail boats, planes and cars, combined with a battery and electric drive motor (69) coupled to the rear wheel 63, and a left/right steering gear (not shown) coupled to the front wheels 62. In FIG. 1 can be seen in dotted line an antenna 66 associated with the radio control receiving unit.

This drive unit may have a variety of different wheel assemblies, examples being front and/or rear wheel drive, or front or rear wheel steering, or a three wheel arrangement with a single front drive and steering wheel. One or more electric motors (not shown) actuate the drive wheel(s) with varying degrees of speed, direction and acceleration. The transmitter has appropriate controls to direct the car's movement, and the receiver has appropriate input and output components to actuate the drive wheel or wheels to accomplish such movement. Transmitter, receiver and drive units exist in the prior art, some of which is referred to in prior art patents listed above.

Figure 3:
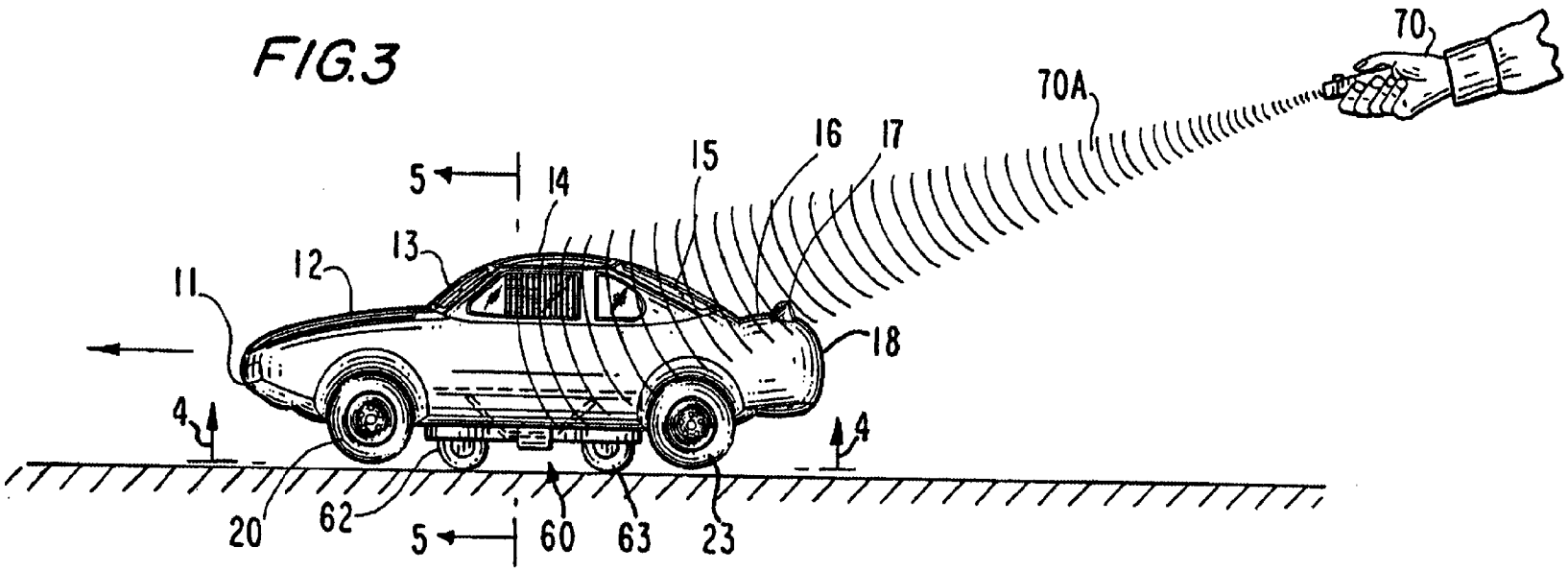
FIG. 3 is a side elevation view of the car of FIG. 1 in radio control mode.
Figure 4:
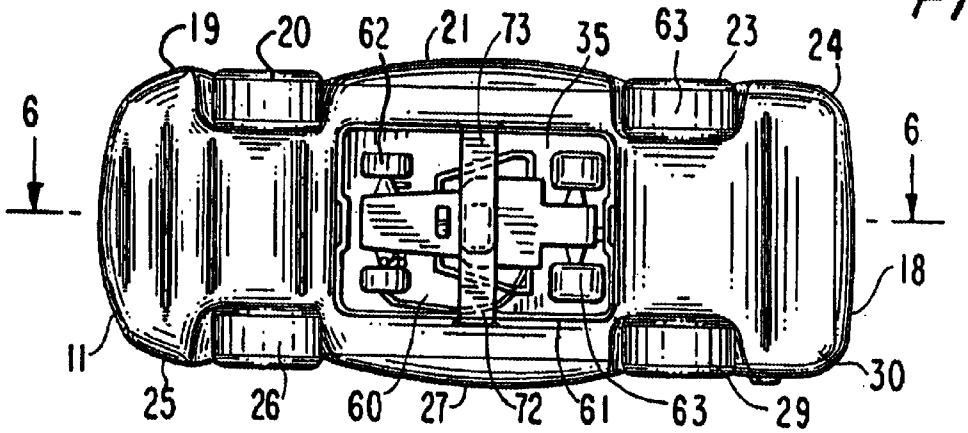
FIG. 4 is a bottom plan of the car of FIG. 1.

FIG. 3 shows the car 10 with the radio control drive unit 60 situated in its lower central portion, and a radio control transmitter 70 held in an operator's hand with simulated radio waves 70A directed to the antenna of the receiving unit for controlling same to turn left and right, and to go forward and rearward and/or to stop. Additional controls for speed are also readily providable in standard radio control drive mechanisms.

A supplemental coupling element for securing the radio control drive unit in its chamber is a set of straps 71 and 72 which have mating Velcro® fastening means 73 on their respective mating surfaces.

FIG. 2 shows left and right walls 57 and 58 of the radio control chamber 35 extended as inward curves as they are naturally inclined to do when the radio control receiving unit 60 is not present. In FIG. 6 front and rear walls 55 and 56 would be bowed inward except that the radio control unit 60 is situated in chamber 35 whose walls 57 and 58 and 55 and 56 become essentially flat as they press against the radio control unit and conform to its shape and retain it securely inside this chamber. These walls hug the radio control unit 60 along its full periphery.

The radio control unit is considerably heavier than the plastic sheet material of the car. Thus positioning this relatively heavier element in the essentially central portion of a relatively large inflatable vehicle establishes a lower and central center of gravity which'stabilizes the car from tipping when it moves and turns.

As mentioned earlier, the various I-beams and internal plastic sheet components which define this vehicle have a plurality of holes or apertures through their surfaces to allow for the air flow between all the respective chambers within one closed air unit. As seen in FIG. 5, there are holes marked 80 and arrows marked 81 indicating the air flow through these holes. FIGS. 2 and 6 have similar holes 80 and arrows 81; however all of the holes and all of the arrows are not designated because it is obvious they are essentially the same.

The result is a highly realistic and highly mobile and rather large vehicle which can be operated from a considerable distance depending on the power of the radio transmitter and receiver and can be driven at substantial speeds depending on the power and speed of the electromechanical drive unit motor, gears and batteries thereof. When this inflatable product has promotional indicia and graphics put on its surfaces, it provides a very practical and inexpensive and effective and perhaps humorous and amusing article or toy for persons using it. It achieves the goals of a large display product while adding the capability of movement to attract attention and to provide entertainment and amusement and to permit the possibility of a display which is not restricted to a single location wherever it is originally situated. It can generate a great amount of attention for a long time and distract people from looking at stationery objects which might be promoting competitive products.

This invention may take a variety of other forms still within the scope and spirit of the invention as defined in the claims appended hereto.

What is claimed is:

1. An inflatable remote control car operable with a radio control transmitter and receiver set including battery power means, comprising an inflatable car body formed of thin air-impervious plastic sheet material, a remote control receiver, and an electrically-powered wheeled drive unit controlled by said receiver, said car body comprising top, bottom, front, rear and side parts which when inflated define a car body shape, and four non-rotating wheels extending downward below the bottom of said car body, said bottom part including an upward recess situated generally centrally of said front, rear and sides of said car body, said upward extending recess defined by front and rear walls, opposite side walls and a top wall which is a ceiling of said recess, said front, rear and side walls tending, when the car body is inflated, to bow inward into said recess, said remote control receiver and drive unit situated in said recess with wheels of said drive unit extending downward to an elevation below the elevation of said inflatable wheels, said receiver operable to receive commands, from said transmitter to cause said drive unit via its rotatable wheels to move said car forward and backward and to turn.

2. An inflatable car according to claim 1 wherein said front, rear and side walls of said recess, when said car body is inflated, press inwardly and against said drive unit.

3. An inflatable car according to claim 1 wherein said car and drive unit in a combination have a center of gravity located generally in the vicinity of said recess.

4. An inflatable car according to claim 1 wherein said recess has a generally rectangular box shape, and said drive unit has a similar generally rectangular box shape, the drive unit fitting within said recess.

5. An inflatable car according to claim 1 wherein said plastic sheet comprises PVC.

6. An inflatable car according to claim 1 wherein said car body has internal structure comprising I-beams which extend to and are joined to said front, rear and side walls of said recess to thereby define the general shape of said recess.

7. An inflatable car according to claim 1 wherein said drive unit has at least three wheels, with at least one said wheels being driven by said drive unit.

8. An inflatable car according to claim 1 wherein said car body defines an upper passenger generally open compartment generally centrally located between front and rear and extending from the roof of said body downward to a mid-level plane and a lower passenger compartment extending from said mid-level plane downward to a floor, said floor also being the ceiling of said recess.

9. An inflatable car according to claim 8 wherein said lower passenger compartment comprises a plurality of adjacent sub-compartments aligned horizontally whose tops establish said mid-plane and whose bottoms establish said floor.

10. An inflatable car according to claim 1 wherein said car body comprises a plurality of compartments which are in mutual air communication such that they are all inflatable from a single air inlet valve.

* * * * *